United States Patent [19]

Kholin

[11] Patent Number: 4,774,928

[45] Date of Patent: Oct. 4, 1988

[54] TENNIS BALL PROJECTOR

[75] Inventor: Boris G. Kholin, Sumy, U.S.S.R.

[73] Assignee: Sumsky Filial Karkovsky Politekhnichesky Institut Imeni V.J. Lenina, Sumy, U.S.S.R.

[21] Appl. No.: 878,987

[22] PCT Filed: Feb. 28, 1985

[86] PCT No.: PCT/SU85/00019

§ 371 Date: May 16, 1986

§ 102(e) Date: May 16, 1986

[87] PCT Pub. No.: WO86/02011

PCT Pub. Date: Apr. 10, 1986

[30] Foreign Application Priority Data

Sep. 28, 1984 [SU] U.S.S.R. ..... 3791135

[51] Int. Cl.[4] ..... F41B 11/00; A63B 69/40

[52] U.S. Cl. ..... 124/75; 273/26 D

[58] Field of Search ..... 124/32, 56, 71, 72, 124/73, 75, 76, 77; 273/26 D, 29 R; 251/45, 19, 20, 21, 22, 78.3, 61

[56] References Cited

U.S. PATENT DOCUMENTS

| | | | |
|---|---|---|---|
| 1,379,403 | 5/1921 | Green | 124/75 |
| 3,400,703 | 9/1968 | Rhodes | 124/75 |
| 3,974,849 | 8/1976 | Dawson | 251/61 |
| 4,108,432 | 8/1978 | Clark et al. | 273/29 A |
| 4,212,284 | 7/1980 | Speer | 124/56 |

FOREIGN PATENT DOCUMENTS

| | | |
|---|---|---|
| 577044 | 10/1977 | U.S.S.R. . |
| 2118443 | 11/1983 | United Kingdom . |

*Primary Examiner*—Robert A. Hafer
*Assistant Examiner*—Michael Brown
*Attorney, Agent, or Firm*—Fleit, Jacobson, Cohn & Price

[57] ABSTRACT

A tennis ball projector comprises a chamber (1) communicating with a source (10) of compressed air. There is also a barrel (13) for projecting balls (16), communicating with the chamber (1) through a valve (27) located close to the end face (14) of the barrel (13), and a branch pipe (17) to admit the balls (16) into the barrel (13). The valve (27) is actuated by a pneumatic chamber (28) communicating with the source (10) of compressed air and also communicating with the atmosphere through an additional valve (32) provided with a remote control arrangement (46).

4 Claims, 1 Drawing Sheet

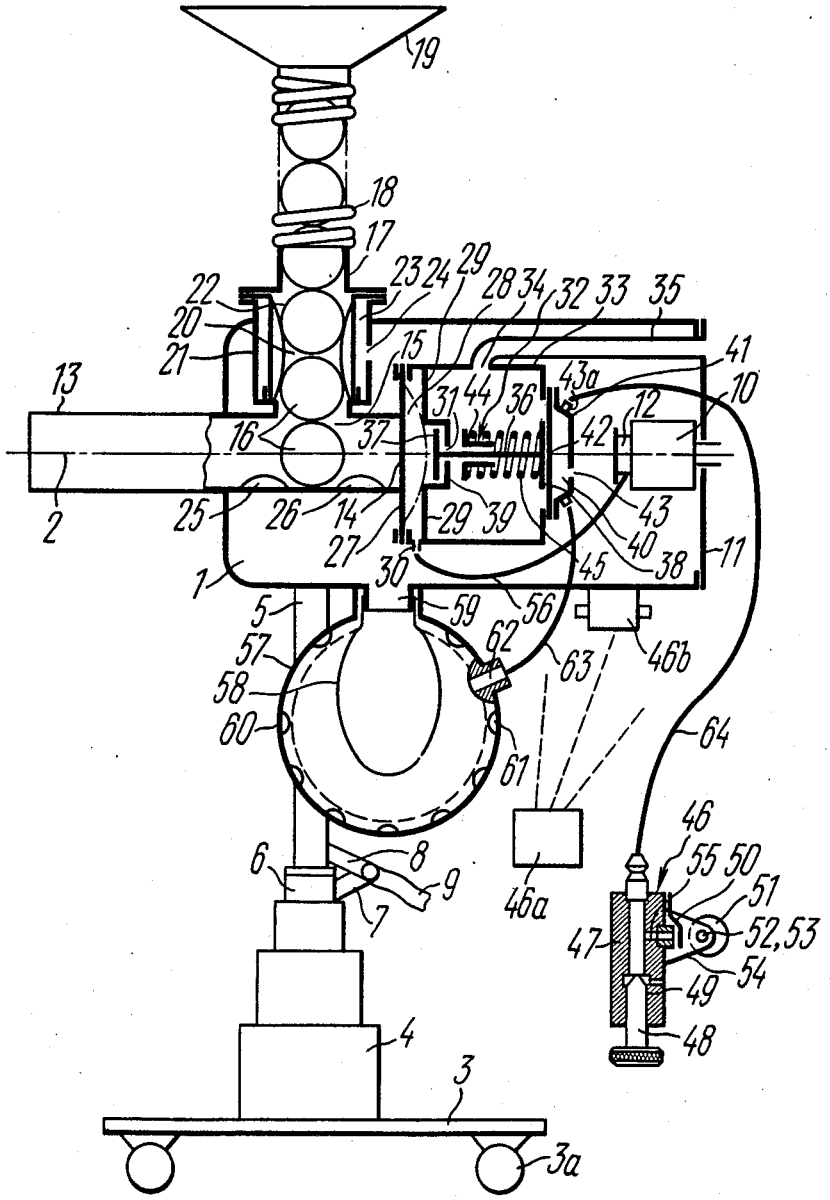
19
18
17
23
24
29
28
34
32
33
35
22
20
21
15
41
13
31
44
36
43a
10
12
16
37
42
2
25
26
14
29
39
43
27
40
38
11
1
30
45
5
59
56
62
46b
57
63
58
60
64
61
46
55
50
6
8
9
51
46a
7
52,53
47
54
49
4
48
3
3a

TENNIS BALL PROJECTOR

The invention relates to apparatuses for sports training, and more specifically to tennis ball projectors.

BACKGROUND ART

Known in the art is a tennis ball projector (cf. USSR Inventor's Certificate No. 577,044, Int. Cl. A 63 B,69/40, "Discoveries, Inventions, Industrial Designs and Trademarks" bulletin No. 39, 1977), comprising a chamber communicating with a source of compressed air.

There is also a ball projection barrel with an outlet end face thereof protruding from the chamber and an inlet end face thereof located in the chamber to admit compressed air therefrom.

The barrel has a side hole wherethrough the barrel communicates with a gate and a branch pipe to admit balls into the gate.

Provision is also made of a valve for periodic communication between the barrel and the chamber, installed close to the chamber-enclosed barrel end face.

The valve is made in the form of a rod-mounted disk interacting with the barrel end face. A spring presses the disk to the barrel inletend face. The valve rod is arranged along the barrel axis in a bushing secured in the chamber cover.

The valve is actuated by an electromagnet with a movable core kinematically associated with the free end of the valve rod by means of a lever. As the core is pulled in or out, the valve is opened or closed respectively. With the valve open, the compressed air is free to enter the barrel and project the ball.

This prior art tennis ball projector may be used effectively for projecting balls at a relatively low speed due to the small effort of the electromagnet to open the valve intended for admission of compressed air into the barrel.

However, to project a ball at a high initial velocity, e.g. to imitate a champion's shot, the effort exerted by the electromagnet must be as great as 400–500N. Such an effort could be attained by increasing considerably the mass of the movable parts of the tennis ball projector and for the electromagnet, which would appreciably augment the weight of the projector and extend essentially the valve opening time.

Slow opening of the valve results in a low efficiency of the tennis ball projector, because the valve opening time is longer than that required for the ball to pass through the barrel. Therefore, a relatively weak flow of compressed air, not a powerful jet of it, enters the barrel, due to which a considerable amount of air is ejected from the barrel after the ball has been shot out. In other words, this amount is not spent for the purpose it is intended for, i.e. for projecting the ball.

DISCLOSURE OF THE INVENTION

The principal object of the present invention is to provide a tennis ball projector, wherein the design of the valve drive would allow the ball projection speed and the projector efficiency to be increased and total weight of the projector decreased.

The foregoing object is attained in a tennis ball projector, comprising a chamber communicating with a source of compressed air, a barrel to project the balls, communicating with the chamber by means of a valve located in the chamber close to the barrel end face and provided with a drive, and also a branch pipe with a gate to admit the balls into the barrel, according to the invention, in which the valve drive is made in the form of a pneumatic chamber permanently communicating with the source of compressed air and also communicating with the atmosphere through an additional valve provided with a remote control arrangement.

The valve drive of the present invention, made in the form of a pneumatic chamber communicating with a source of compressed air and also communicating with the atmosphere through an additional valve allows the valve opening time to be reduced to a minimum.

This has been made possible due to the fact that the mass of said valve drive is very small, and the valve opening time is shorter than that required for the ball to pass through the barrel, because such a design ensures a very quick opening of the valve to admit compressed air into the barrel. As a result, all its energy accumulated in the chamber is spent on imparting the requisite initial velocity to the ball.

It is expedient that the valve be made in the form of a diaphragm with a diameter exceeding the diameter of the barrel to admit compressed air as a result of the diaphragm deflection, the pneumatic chamber be formed by the diaphragm and a cover, with at least one hole to communicate it with a source of compressed air, and a central hole, the additional valve be provided with a body communicating with the atmosphere and enclosing a spring-loaded rod passing through the central hole in the cover and carrying thrust members at the ends, the first member, located in the pneumatic chamber, being intended for shutting off the central hole, and the second thrust member, located in the body, being controlled through an additional pneumatic chamber formed by an additional cover with at least one hole to admit compressed air and an additional diaphragm meant for interaction with the second thrust member.

Such a design allows the energy of compressed air to be accumulated and the ball to be projected in an explosion-like manner.

The diameter of the diaphragm is made larger than the diameter of the barrel to form a channel sufficient for the compressed air to pass during the ejection.

Communicating the additional valve body with the atmosphere heightens the effect of the compressed air energy accumulated in the chamber being released, as it increases the pressure differential in the chamber and the pneumatic chamber.

It is favourable that the remote control arrangement comprise a body with a cavity thereof communicating with the additional pneumatic chamber and enclosing a throttle to control the ball projection rate in the automatic control mode, and a control valve for single shots in the manual control mode and for changing over from the manual to the automatic control mode.

Such a design permits a rather simple and reliable ejection of balls in the automatic control mode with the valve closed. The automatic control mode is easily set by varying the degree of the throttle opening. Single shots are easily adjusted by opening or closing the valve.

It is recommended that provision be made of a tube for communicating the hole of the pneumatic chamber with the source of compressed air.

This tube ensures a reliable closing of the pneumatic valve central hole, which is also conductive to reduced power of compressed air pulse.

It is also desirable that use be made of a pneumatic accumulator comprising two resilient envelopes disposed one inside the other, the cavity formed by the inner resilient envelope communicating with the chamber and the outer envelope having holes to communicate the cavity between the inner and the outer envelopes with the atmosphere, and a hole communicating with the additional pneumatic chamber through the pneumatic tube and shut off by the inner resilient envelope as it is being distended by compressed air.

The provision of the pneumatic accumulator allows the power of compressed air pulse ejecting the ball to be considerably increased, which is particularly essential with a low-pressure blower being used as a source of compressed air.

In the latter case the pneumatic accumulator represents an additional container of compressed air, which is ejected therefrom at the required moment, to be forced into the barrel together with the main body of compressed air.

Thus, the relatively light tennis ball projector of the present invention features a high efficiency and permits a steady ejection of balls at any initial velocity, both low and high.

The tennis ball projector of the invention is compact in size, simple in design, and reliable and convenient in operation.

BRIEF DESCRIPTION OF THE DRAWING

The invention will now be described in terms of a specific embodiment thereof with reference to the accompanying drawing, which is a longitudinal section of a tennis ball projector, according to the present invention.

BEST MODE OF CARRYING OUT THE INVENTION

A tennis ball projector of the invention comprises a cylindrical chamber 1 with a longitudinal axis 2, installed on a base 3 with the aid of a telescopic rod 4 to vary the height of the chamber 1 over the floor level. The base 3 has wheels 3a for rolling the ball projector across the tennis court.

The upper part of the telescopic rod 4 is coupled to a fork 5 through a bearing assembly 6 of any known design suitable for the purpose, the fork 5 being rotatable around a vertical axis (not indicated by a numeral). The fork 5 and and the vertical axis with the aid of a cable 9.

The fork 5 has two legs (one is shown in the figure) coupled with the chamber 1 by hinges of any known design suitable for the purpose (not shown in the figure) to allow rotation of the chamber 1 around a horizontal axis (not shown) passing through these hinges perpendicularly to the drawing plane.

The chamber 1 communicates with a source of compressed air, which is actually a centrifugal blower 10 of a known design, disposed in the chamber 1 and attached to its cover 11. The centrifugal blower 10 is provided with a branch pipe 12 to pass compressed air from the blower 10 to the chamber 1.

Provision is made of a barrel 13 which is essentially a cylindrical tube arranged along the axis 2.

An end face 14 of the barrel 13 is enclosed in the chamber 1. An outlet end (not indicated by a numeral) of the barrel 13 is disposed beyond the chamber 1. The barrel 13 has a side hole 15 for balls 16 to pass into the barrel 13.

A branch pipe 17 communicates with a bin 19 through a flexible tube 18 made in the form of a spring.

The upper part of a gate 20 fitted in the upper part of the chamber 1 is secured to the branch pipe 17 with the aid of flanges (not indicated by numerals). The lower part of the gate 20 adjoins the side hole 15 of the barrel 13.

The gate 20 is a rigid cylindrical bushing 21 housing a resilient bushing 22 coaxially therewith. The upper and the lower ends of the resilient bushing 22 tightly fit the rigid bushing 21, with a clearance 23 being formed between the rigid bushing 21 and the resilient bushing 22; the clearance communicates with the chamber 1 through a hole 24.

The gate 20 is used to hold back each successive ball 16 as the preceding one is being shot out, and also to prevent compressed air from escaping through the side hole 15 during the ejection. The barrel 13 is provided with limiters 25 and 26 to secure the first in turn ball 16 in the initial position prior to the shot. The limiters 25 and 26 are actually lugs made inside the barrel 13 on the lower (as shown in the FIGURE) surface thereof.

The barrel 13 communicates with the chamber 1 through a valve 27 located in the chamber 1 close to the end face 14 of the barrel 13. The valve 27 is made in the form of an elastic diaphragm with the same reference numeral 27 in the figure, its diameter exceeding that of the barrel 13.

The valve 27 has a drive comprising a pneumatic chamber 28. The pneumatic chamber 28 is formed by the diaphragm 27 and a cover 29, whereto it is affixed peripherally with the aid of flanges (not indicated by numerals).

The cover 29 has a side hole 30 accommodating a pipe union (not indicated by a numeral) and a central hole 31. The pneumatic chamber 28 communicates with the blower 10 through the side hole 30 and through the cavity in the chamber 1.

The diaphragm 27 adjoins the end face 14 of the barrel 13 as compressed air accumulates in the pneumatic chamber 28.

An additional valve 32 communicates the pneumatic chamber 28 with the atmosphere. The additional valve 32 has a cylindrical body 33 communicating with the atmosphere and disposed in the chamber 1 along the axis 2 thereof.

The body 33 communicates with the atmosphere through a hole 34 in its side wall by means of a tube 35 communicating the hole 34 with a hole (not indicated by a numeral) in the cover 11 of the chamber 1.

The additional valve 32 is a spring-loaded rod 36 passing through the central hole 31 in the cover 29 and carrying thrust members 37 and 38 at the ends.

The first thrust member 37 is a disk located in the pneumatic chamber 28 and intended for interaction with a saddle 39 formed by a portion of the cover 29 around its central hole 31.

The second thrust member 38 is also a disk located in the body 33 and controlled through an additional pneumatic chamber 40 which is formed by an additional cover 41 and an additional diaphragm 42. The additional cover 41 has a hole 43 to admit compressed air and a hole 43a with a diameter calculated on the basis of the required rate of projecting balls 16. The additional diaphragm 42 is intended for interaction with the second thrust member 38 to open the central hole 31.

The rod 36 is fitted in a guide bushing 44 mounting a spring 45 meant for pressing the thrust member 37 to the saddle 39 and secured to the body 33 (not shown in the FIGURE).

The additional valve 32 is provided with a remote control arrangement 46 comprising a body 47, with the cavity thereof communicating with the additional pneumatic 40, and a throttle 48 installed therein.

The throttle 48 made in the form of a threaded rod, which is designated with the same reference numeral in the FIGURE, has a tapering end (not indicated by a numeral) fitting the body 47 and the other end, located outside of the body 47, terminating with a head (not indicated by a numeral). The throttle 48 is accommodated in a hole 49 in the end face (not indicated by a numeral) of the body 47.

The remote control arrangement 46 also comprises a control valve 50 carrying a disk 51 with an eccentric hole 52 to mount the disk on an axle 53 clamped by lugs 54. The lugs 54 are secured on the side wall (not indicated by a numeral) of the body 47 near a hole 55 closed during automatic operation of the tennis ball projector and open with the latter operating in the manual control mode set by rotating the disk 51 around the axle 53.

The disclosed embodiment of the tennis ball projector may be provided with a program control arrangement **46*a* of any known design suitable for the purpose, which allows shots to be made in conformity with the present program, with the balls 16** being projected to different spots of the tennis court at a predetermined rate and speed from several projectors.

In the latter case, i.e. with several tennis ball projectors being used on a single court, the remote control arrangement 46 is replaced by a valve **46*b* communicating with the additional pneumatic chamber 40. The valves 46*b* of all tennis ball projectors are connected with the program control arrangement 46*a*** (the conections are shown by dash lines in the FIGURE).

Placing on a court several tennis ball projectors with such valves **46*b* connected with the program control arrangement 46*a* exercising the control of these valves 46*b*** allows shots to be performed from tennis ball projectors installed in different sectors of the court, at different speeds and in different directions in conformity with the predetermined program, and thus complicated game situations to be modelled.

A tube 56 communicates the hole 30 in the cover 29 of the pneumatic chamber 28 with the blower 10, thereby ensuring reliable closing of the valve 27, for the pressure of compressed air fed directly from its source 10 is higher than that in the chamber 1 when the latter is initially filled with compressed air.

In the event of the low-pressure blower 10 being used as a source of compressed air the chamber 1 mounts a pneumatic accumulator 57 with an inner resilient rubber envelope 58, whose cavity communicates with the chamber 1 through a branch pipe 59.

An outer envelope 60 has holes 61 to communicate the cavity between the inner envelope 58 and the outer envelope 60 with the atmosphere, and a hole 62 communicating with the additional pneumatic chamber 40 through a pneumatic tube 63 and shut off by the inner resilient envelope as the latter is distended with compressed air to assume the position shown in the FIGURE by a dash line. Provision is also made for a tube 64 for remote control of the tennis ball projector at any distance.

The tennis ball projector of the present invention operates in the following manner.

The ball 16 rolls from the bin 19 to the starting position in the barrel 13 through the flexible tube 18 and the branch pipe 17. The balls 16 that follow it remain in the gate 20.

The blower 10 is then cut into operation to force air into the chamber 1 through the branch pipe 12. Simultaneously, compressed air forced through the hole **43*a* flows into the additional pneumatic chamber 40 and, passing through the pipe 56 and the side hole 30 in the cover 29, enters the pneumatic chamber 28**.

The thrust member 38 of the spring-loaded rod 36 tightly fitting the saddle 39, the pressure in the pneumatic chamber 28 rises, and the diaphragm 27 is tightly pressed against the end face 14 of the barrel 13, thereby preventing compressed air against escaping from the chamber 1 into the barrel 13. As a result, the pressure in the chamber 1 is quickly built up to reach the prearranged value determined by the specifications of the blower 10.

As soon as the pressure in the additional pneumatic chamber 40 has risen to a value sufficient to set the spring-loaded rod 36 in motion, the latter instantaneously moves to the extreme left (as shown in the FIGURE) position. As this takes place, the additional diaphragm 42 acts upon the thrust member 38 which, aided by the spring-loaded rod 36, actuates the second thrust member 37, making it recede from the saddle 39, thereby opening the passage of compressed air into the atmosphere through the central hole 31 and the tube 35. As a result, an atmospheric pressure is established in the pneumatic chamber 28.

The pressure in the pneumatic chamber 1 exceeding atmospheric pressure, the diaphragm 27 immediately assumes the position shown by the dash line in the FIGURE, thus making it possible for compressed air to flow from the chamber 1 into the barrel 13 and project the ball 16 from the barrel 13.

At the moment of shot, the ball 16 being in the gate 20 is squeezed by the resilient bushing 22 because compressed air flows through the hole 24 into the clearance 23 between the rigid bushing 21 and the resilient bushing 22, which latter retains the ball 16 to prevent a air leakage through the gate 20. After ejection of the ball 16, the next ball 16 from the gate 20 takes its place in the barrel 13, and the cycle described hereinabove is repeated.

With the pneumatic accumulator 57 being used, compressed air flows from the chamber 1 through the branch pipe 59 to enter the resilient envelope 58, which gradually distends to close the hole 62.

The process proceeds as described hereinabove, whereas the pneumatic accumulator 57, being the additional container of compressed air, expels it through the branch pipe 59 into the chamber 1 and the barrel 13.

Whenever the need for remote control of the tennis ball projector in the automatic mode arises, the operator closes the hole 55 of the arrangement 46 by the disk 51, the supply of compressed air being regulated by the throttle 48.

If single shots are desirable, the operator alternately opens and closes the hole 55 by turning the disk 51 around the axle 53.

An experimental model of a tennis ball projector has been manufactured and tested successfully during tennis players' and hockey players' (goalkeepers') training. Another experimental model has been developed for use in footballers' training.

The tennis ball projector of the invention is capable of projecting balls in different directions at different speeds in compliance with the preset programs worked out by the coach or by the sportsman himself. The parameters of the ball flight, e.g. initial velocity, direction, ejection time and flying speed, may be modelled to copy champions' shots or excel them considerably, which is particularly essential for tennis players to upgrade their sportsmanship at a high rate.

INDUSTRIAL APPLICABILITY

The tennis ball projector of the invention may be used to the best advantage for the training of tennis players.

The tennis ball projector of the invention may also be used for the training of footballers, hockey players, baseballers, i.e. in all ball games.

We claim:

1. A tennis ball projector comprising:

a chamber communicating with a source of compressed air, a barrel to project balls, communicated with the chamber through a valve located in the chamber close to an end face of the barrel and having a drive, and also a branch pipe with a gate to admit balls into the barrel, the drive of the valve is being a pneumatic chamber permanently communicating with the source of compressed air and also communicating with the atmosphere through an additional valve provided with a remote control arrangement, the valve being a diaphragm with a diameter exceeding the diameter of the barrel to admit compressed air thereinto when the diaphragm is deflected, the pneumatic chamber being formed by the diaphragm and a cover with at least one hole to communicate it with the source of compressed air, and a central hole, the additional valve having a body communicating with the atmosphere and accommodating a spring-loaded rod passing through the central hole in the cover and carrying first and second thrust members at the ends, the first member of said thrust members being located in the pneumatic chamber and adapted to shut the central hole, and the second of said thrust members being located in the body and controlled through an additional pneumatic chamber formed by an additional cover with at least one hole to admit compressed air and an additional diaphragm adapted to interact with the second thrust member.

2. A tennis ball project as claimed in claim 1, wherein the remote control arrangement comprises a body with a cavity thereof communicating with the additional pneumatic chamber and a throttle controls the projection rate of the balls in a first control mode and a control valve adapted to make single shots in a second control mode and to change to the first control mode.

3. A tennis ball projector as claimed in claim 1, wherein a tube is provided for communication of the pneumatic chamber with the source of compressed air.

4. A tennis ball projector as claimed in claim 1, wherein a pneumatic accumulator includes two resilient envelopes disposed one inside the other, and a cavity formed by the inner resilient envelope communicating with the chamber and the outer envelope having holes to communicate the cavity between the inner envelope and the outer envelope with the atmosphere, and a hole communicating with the additional pneumatic chamber through a pneumatic tube and shut off by the inner resilient envelope as the inner resilient envelope is distended by compressed air.

* * * * *